United States Patent [19]

Mizuguchi et al.

[11] Patent Number: 4,913,023

[45] Date of Patent: Apr. 3, 1990

[54] BAR FOR USE IN ELECTRONIC PERCUSSION SYSTEM

[75] Inventors: Masaaki Mizuguchi; Hirohisa Kuroyanagi, both of Shizuoka, Japan

[73] Assignee: Yamaha Corporation, Hamamatsu, Japan

[21] Appl. No.: 116,235

[22] Filed: Nov. 3, 1987

[30] Foreign Application Priority Data

Nov. 4, 1986 [JP] Japan ..... 61-262424

[51] Int. Cl.[4] ..... G10H 3/14

[52] U.S. Cl. ..... 84/723; 84/404; 84/DIG. 12; 84/DIG. 21

[58] Field of Search ..... 84/1.04, 1.06, 1.14, 84/1.15, 402–404, 410, DIG. 7, DIG. 12, DIG. 21, DIG. 24; 446/418; 177/134, 210 EM, 210 C, 210 R, 253; 128/777

[56] References Cited

U.S. PATENT DOCUMENTS

| | | | |
|---|---|---|---|
| 1,575,961 | 3/1926 | Bartholomae | 84/403 |
| 1,632,751 | 6/1927 | Winterhoft | 84/403 |
| 1,838,502 | 12/1931 | Schluter | 84/403 |
| 2,581,963 | 1/1952 | Langloys | 84/1.15 X |
| 2,845,697 | 8/1958 | Adler | 84/402 X |
| 2,898,795 | 8/1959 | Kunz | 84/1.04 X |
| 3,595,119 | 7/1971 | Kuijpers | 84/403 |
| 3,684,814 | 8/1972 | Neustadt | 84/1.04 |
| 4,281,728 | 8/1981 | Dickason et al. | 177/134 |
| 4,488,873 | 12/1984 | Bloomfield et al. | 128/777 X |

FOREIGN PATENT DOCUMENTS

| | | | |
|---|---|---|---|
| 0254632 | 7/1926 | United Kingdom | 84/402 |

*Primary Examiner*—Stanley J. Witkowski

*Attorney, Agent, or Firm*—Burns, Doane, Swecker & Mathis

[57] ABSTRACT

For detecting a difference in rendition, a bar incorporated in an electronic percussion system includes a supporting block having a surface portion, a top member having a first surface portion and a second surface portion located at the reverse side of the first surface portion, and a force sensitive unit intervening between the surface portion of the supporting block and the second surface portion of the top member and converting a force acting on the first surface portion into an electric signal, wherein the first surface portion is formed with a rugged surface which causes a striker to intermittently strike the first surface portion when the striker moves along the first surface portion.

8 Claims, 4 Drawing Sheets

BAR FOR USE IN ELECTRONIC PERCUSSION SYSTEM

FIELD OF THE INVENTION

This invention relates to a bar for use in an electronic percussion system and, more particularly, to a bar of an electronic percussion system corresponding to the tuned bar of, for example, an acoustic xylophone or an acoustic marimba.

BACKGROUND OF THE INVENTION

A typical musical instrument of the acoustic percussion family such as, for example, a xylophone or a marimba is provided with tuned bars in keyboard arrangement and gradated in length to provide a chromatic scale of three or four octaves. When a performer strikes the bars with rubber-tipped mallets, the bars vibrate at the respective natural frequencies which cause the bars to produce respective tones so as to make a fine melody.

However, in an electronic percussion instrument corresponding to the xylophone or the marimba, tones are produced by a tone generation unit incorporated therein so that bars are only expected to detect strikings with the the mallets. Then, a typical bar incorporated in the electronic percussion instrument forms an electric switch for detecting the striking with the mallet and the structure thereof is illustrated in FIG. 1.

Referring to FIG. 1 of the drawings, there is shown a typical example of the bar incorporated in the electronic percussion instrument. The bar comprises a supporting member 1 of an insulating material and a conductive wirings 2 which are patterned on the upper surface of the supporting member 1. On the upper surface of the supporting member 1 is further mounted a mechanical switch 3 which has an actuator 4 movable into or out of a casing 5. Though not shown in the drawings, the actuator 4 causes a pair of contacts (not shown) to be closed or open depending upon the movement thereof. The contacts are coupled to a pair of conductive wirings 2, respectively, then the switch 3 produces an electric signal when being depressed. The conductive wirings are sandwiched between the supporting member 1 and a covering plate 6 which has a step portion forming a hollow space. A top plate 7 is located in the hollow space and contacted to the actuator 4 of the switch 3. The peripheral portion of the top plate 7 is supported by the step portion of the covering plate 6 under a suitable force exerted thereon so that the top plate 7 depresses the actuator 4 for causing the switch 3 to produce the electric signal but does not crust the switch 3. When a performer strikes the bar illustrated in FIG. 1 with a rubber-tipped mallet 8, the top plate 7 moves downwardly and depresses the actuator 4, then the switch 3 produces the electric signal representing the strike of the mallet 8.

Another example of bar incorporated in an electronic percussion system is illustrated in FIG. 2. The bar illustrated in FIG. 2 comprises a supporting member 11 formed with a stepped portion forming a cavity, a top plate 12 located in the cavity, and a resilient film 13 intervening between the supporting member 11 and the top plate 12. In a space formed between the supporting member 11 and the top plate 12 is provided a piezo-electric member 14 attached to the top plate 12. The bar thus arranged is operative to produce an electric signal when the piezo-electric member 14 is caused to be exerted with pressure due to the movement of the top plate 12.

The prior-art bars illustrated in FIGS. 1 and 2 are operative to produce the electric signals representing the strikes of the mallets, respectively, based on the forces acting on the top plates 7 and 12. However, a problem has been encountered in the prior-art bars in that the electric signals could not reflect a difference in rendition. Namely, there are several renditions for percussion performance such as, for example, tremolo or glissando. When a performer rapidly slides the mallet over the bars of the electronic percussion system, each of the bars produces the electric signal having a certain waveform. However, the signal due to sliding the mallet is similar in waveform to that produced upon simply striking with the mallet in so far as time periods of depression are equal to each other.

It is therefore an important object of the present invention to provide a bar suitable for an electronic percussion system.

It is also an important object of the present invention to provide a bar capable of producing electric signals reflecting a difference in rendition.

SUMMARY OF THE INVENTION

To accomplish these objects, the present invention proposes to form a rugged surface in a top member so as to cause a striker to intermittently strike the top member upon sliding.

In accordance with the present invention, there is provided a bar for detecting a strike with a striker incorporated in an electronic percussion system, comprising, a) a supporting block having a surface portion, b) a top member having a first surface portion extending in first and second directions perpendicular to each other and a second surface portion located at the reverse side of the first surface portion, a force due to the strike acting on the first surface portion, and c) a force sensitive unit intervening between the surface portion of the supporting block and the second surface portion of the top member and converting the force acting on the first surface portion into an electric signal, wherein the first surface portion is formed with a rugged surface with respect to a plane defined by the first and second directions, and the rugged surface causes the striker to intermittently strike the first surface portion when the striker moves in a direction parallel to the plane defined by the first and second directions.

BRIEF DESCRIPTION OF THE DRAWINGS

The features and advantages of a bar according to the present invention will be more clearly understood from the following description taken in conjunction with the accompanying drawings in which.

DESCRIPTION OF THE PREFERRED EMBODIMENTS

First Embodiment

Figure 1:
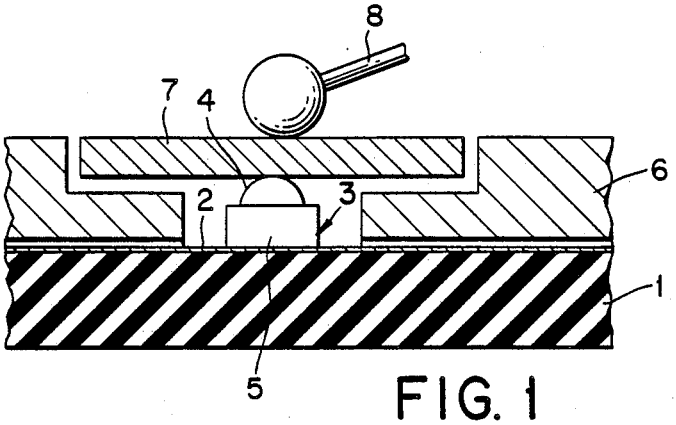
FIG. 1 PRIOR ART
FIG. 1 is a sectional view showing a typical example of prior-art bar incorporated in an electronic percussion system.
Figure 2:
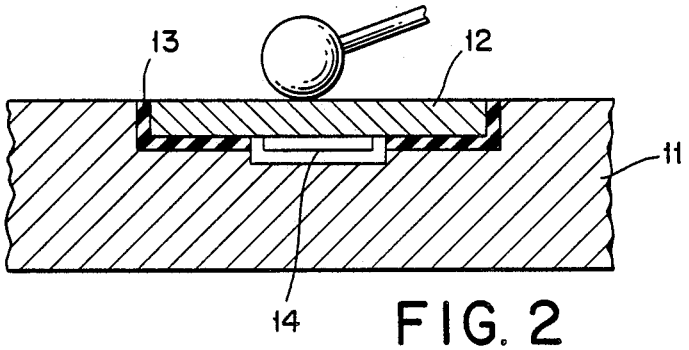
FIG. 2 PRIOR ART
FIG. 2 is a sectional view showing another example of prior-art bar incorporated in an electronic percussion system.
Figure 3:
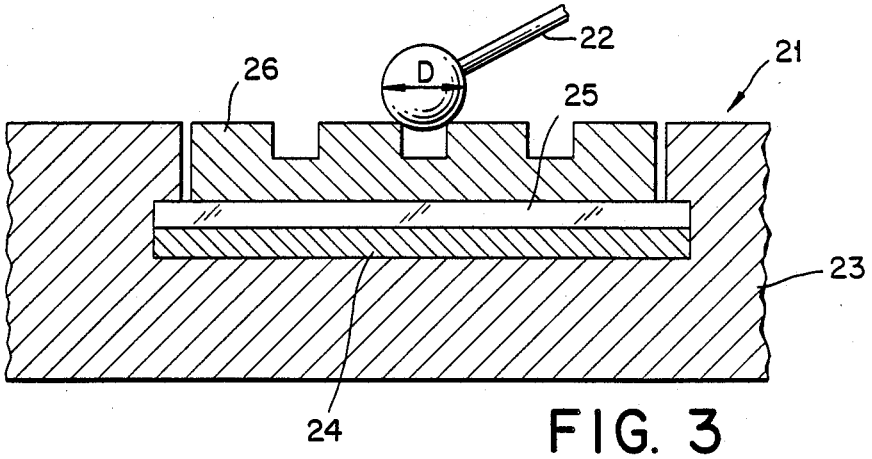
FIG. 3 is a sectional view showing the structure of a first embodiment according to the present invention.

Referring to FIG. 3 of the drawings, there is shown the structure of a bar 21 according to the present invention together with a rubber-tipped mallet 22. Though not shown in the drawings, a plurality of bars 21 are disposed in two rows like an acoustic marimba and associated with a controller unit which communicates the bars and produces tone signals. The tone signals are supplied to a sound system (not shown), then synthetic tones are produced on the basis of the tone signals supplied from the controller.

Each bar 21 comprises a supporting member 23 formed with a wide groove, a resilient member 24 disposed on the bottom surface portion of the supporting member 23, a force sensitive plate 25 disposed on the resilient member 24, and a top member 26 mounted on the force sensitive plate 25. In this instance, the resilient member 24 is formed of a rubber and the force sensitive member 25 is formed of, for example, force sensing resistor which is a product of Interlink Electronics in the U.S.A. This device is a resistor of which conductivity varies depending upon the pressure applied thereto. The total thickness of the resilient member 24, the force sensitive plate 25 and the top member 26 is approximately equal to the depth of the wide groove so that the uppermost surface of the top member 26 is substantially coplanar with the uppermost surface of the supporting member 23. The supporting member 23 and the resilient member 24 form in combination a supporting block.

Figure 4:
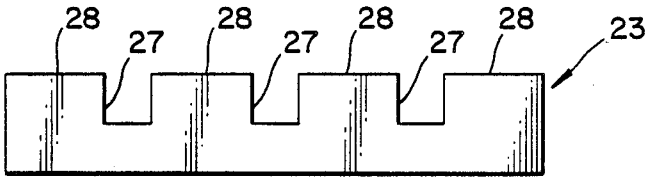
FIG. 4 is a front view showing, to an enlarged scale, a top member forming part of the bar illustrated in FIG. 3.
Figure 5:
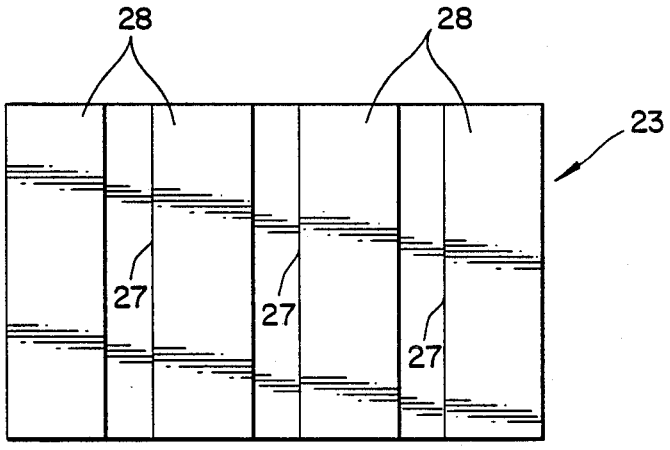
FIG. 5 is a plan view showing the top member of the bar illustrated in FIG. 3.

As will be seen from FIGS. 4 and 5, the top member 26 is formed with a plurality of narrow grooves 27 arranged in parallel to one another and the narrow grooves 27 divide the surface portion of the top member 26 into a plurality of land portions 28. Each of the narrow grooves 27 has a width smaller in value than the diameter D of the rubber tip of the mallet 22. The top member 26 thus arranged causes the mallet 22 traveling along the upper surfaces of the land portions 28 to intermittently strike the shoulder of the land portions 28.

When a performer simply strikes the top member 26 with the mallet 22, the force sensitive plate 25 produces an electric signal with a single peak, then the controller forms a tone signal representing the simple strike with the mallet 22 based on the electric signal with the single peak. On the other hand, when a performer slides the mallet 22 along the surfaces of the lands 28, the mallet 22 intermittently strikes the shoulders of the land portions 28, then the force sensitive plate 25 produces an electric signal with multi-peaks, then the controller synthesizes a tone signal representing the glissando rendition based on the electric signal with the multi-peaks.

Second Embodiment

Figure 6:
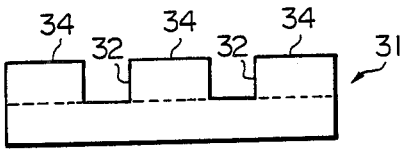
FIG. 6 is a front view showing a top member forming part of a second embodiment according to the present invention.
Figure 7:
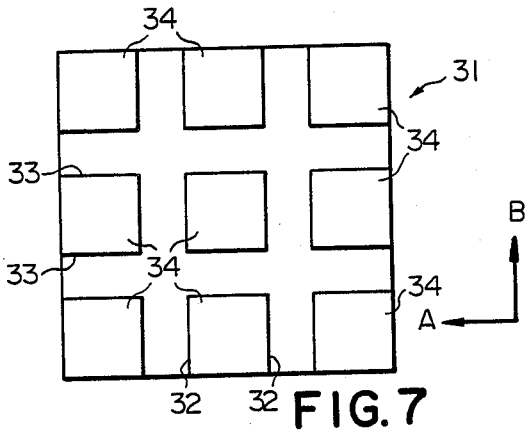
FIG. 7 is a plan view showing the top member of the second embodiment illustrated in FIG. 6.

Turning to FIGS. 6 and 7 of the drawings, there is shown the structure of another top member of a bar embodying the present invention. Since the second embodiment is essentially similar in construction to the bar 21 illustrated in FIG. 3, only the top member will be described. The top member 31 illustrated in FIGS. 6 and 7 are mounted on a force sensitive plate corresponding to the forces sensitive plate 25 and associated with a controller (not shown). The top member 31 incorporated in the second embodiment is formed with a first group of narrow grooves 32 arranged in parallel to each other and a second group of narrow grooves 33 also arranged in parallel to each other. The narrow grooves 32 extend in crossing relationship to the narrow grooves 33 so that the surface portion of the top member 31 is divided into a plurality of land portions 34 disposed in rows and columns. The top member 31 of the second embodiment thus arranged causes a mallet traveling in a direction either A or B to intermittently strike the shoulders of the land portions 34.

Third Embodiment

Figure 8:
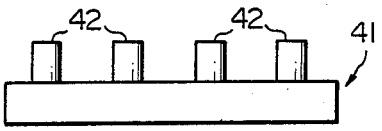
FIG. 8 is a front view showing a top member forming part of a third embodiment according to the present invention.
Figure 9:
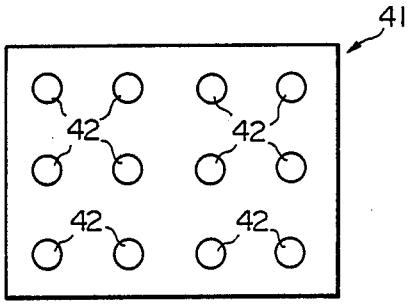
FIG. 9 is a plan view showing the top member of the third embodiment illustrated in FIG. 8.

Turning to FIGS. 8 and 9 of the drawings, a top member incorporated in another bar embodying the present invention is shown and generally indicated at 41. The top member 41 has a surface portion consisting of a plurality of cylindrical protrusions 42 arranged in rows and columns. Each cylindrical protrusion is spaced apart from the neighboring cylindrical protrusion 42 by a preselected distance which is smaller in value than the diameter of a rubber tip of a mallet corresponding to the mallet 22.

In a performance, if the performer slides the mallet along the surface portion of the top member 41 in any direction, the mallet intermittently strikes the upper edges of the cylindrical protrusions 42, then a force sensitive member corresponding to the force sensitive plate 25 produces an electric signal with multi-peaks on the basis of the intermittent strikes.

Fourth Embodiment

Figure 10:
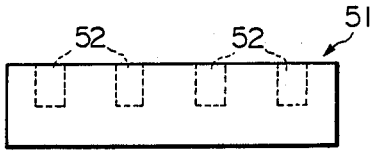
FIG. 10 is a front view showing a top member of a fourth embodiment according to the present invention.
Figure 11:
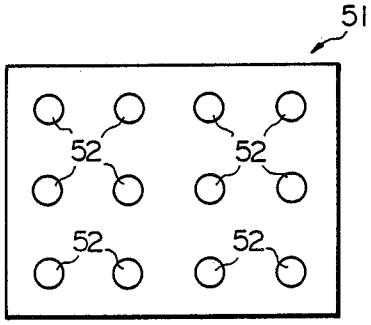
FIG. 11 is a plan view showing the top member of the fourth embodiment illustrated in FIG. 10.

Turning to FIGS. 10 and 11 of the drawings, a top member of still another bar embodying the present invention is illustrated and designated by reference numeral 51. The top member 51 has a surface portion in which a plurality of cylindrical cavities 52 are formed. The cylindrical cavities 52 are formed in rows and columns and the diameter of each of the cylindrical cavities 52 is smaller in value than the diameter of a rubber tip of a mallet corresponding to the mallet 22.

The surface portion of the top member 51 thus arranged is useful to cause the mallet to intermittently strike the edges of the surface portion defining the openings of the cylindrical cavities 52. Then, a controller can produce an electric signal with multi-peaks representing the intermittent strikes of the mallet.

Although particular embodiments of the present invention have been shown and described, it will be obvious to those skilled in the art that various changes and modifications may be made without departing from the spirit and scope of the present invention. For example, another types of a force sensitive material or a mechanical switch may be available. Moreover, the bar according to the present invention may be available for measurement of a moving distance.

What is claimed is:

1. A bar incorporated in an electronic percussion system for providing a timing to produce a synthetic tone, comprising:

(a) a supporting block having a surface portion;

(b) a top member having a first surface portion extending in first and second directions perpendicular to each other and a second surface portion located at the reverse side of the first surface portion, a force acting on said first surface portion when a striker makes a strike on the first surface portion; and (c) a force sensitive unit intervening between the surface portion of said supporting block and the second surface portion of said top member and converting said force acting on said first surface portion into an electric signal, wherein said first surface portion is formed with a rugged surface with respect to a plane defined by said first and second directions, said rugged surface extending at least said first and second directions, said rugged surface causing said striker to intermittently strike said first surface portion when said striker moves in a direction parallel to the plane defined by said first and second directions.

2. A bar as set forth in claim 1, in which said rugged surface forms a plurality of grooves arranged in parallel to one another.

3. A bar as set forth in claim 1, in which said rugged surface forms a first group of grooves arranged in parallel to one another and a second group of grooves arranged in parallel to one another, said first group of grooves crossing said second group of grooves.

4. A bar as set forth in claim 1, in which said rugged surface forms a plurality of depressions arranged in rows and columns.

5. A bar as set forth in claim 4, in which each of said depressions has a circular cross section.

6. A bar as set forth in claim 1, in which said rugged surface forms a plurality of protrusions disposed in rows and columns.

7. A bar as set forth in claim 6, in which each of said protrusions has a circular cross section.

8. A bar as set forth in claim 1, in which the surface portion of said supporting block is provided with a resilient layer.

* * * * *